US010299637B2

(12) United States Patent
Gottschalk

(10) Patent No.: US 10,299,637 B2
(45) Date of Patent: May 28, 2019

(54) TOILET-PAPER-ROLL HOLDER

(71) Applicant: ILLE Papier-Service GmbH, Altenstadt (DE)

(72) Inventor: Eric Gottschalk, Bruchköbel (DE)

(73) Assignee: ILLE PAPIER-SERVICE GMBH, Altenstadt (DE)

( * ) Notice: Subject to any disclaimer, the term of this patent is extended or adjusted under 35 U.S.C. 154(b) by 0 days.

(21) Appl. No.: 15/562,941

(22) PCT Filed: Apr. 13, 2016

(86) PCT No.: PCT/EP2016/058116
§ 371 (c)(1),
(2) Date: Sep. 29, 2017

(87) PCT Pub. No.: WO2016/166157
PCT Pub. Date: Oct. 20, 2016

(65) Prior Publication Data

US 2018/0084953 A1 Mar. 29, 2018

(30) Foreign Application Priority Data

Apr. 13, 2015 (DE) ..... 10 2015 105 580

(51) Int. Cl.
*A47K 10/36* (2006.01)
*A47K 10/38* (2006.01)

(52) U.S. Cl.
CPC ..... *A47K 10/3687* (2013.01); *A47K 10/38* (2013.01)

(58) Field of Classification Search
CPC ..... A47K 10/3687; A47K 2010/3253; A47K 10/3253; A47K 10/38
See application file for complete search history.

(56) References Cited

U.S. PATENT DOCUMENTS 2,592,346 A * 4/1952 Scogin ..... A47F 1/08 221/289
2,767,930 A * 10/1956 McCants ..... A47K 10/38 242/560.3

(Continued)

FOREIGN PATENT DOCUMENTS

CH 571994 A5 1/1967
DE 2 205 186 A1 8/1973

(Continued)

OTHER PUBLICATIONS

International Search Report and International Preliminary Report on Patentability dated Jun. 16, 2016 for Application No. PCT/EP2016/058116.

(Continued)

*Primary Examiner* — Michael E Gallion
(74) *Attorney, Agent, or Firm* — Ladas & Parry LLP; Malcolm J. MacDonald

(57) ABSTRACT

A holder (10) for at least two toilet-paper rolls (12, 14) which are arranged one above the other and consist of a paper web (56) wound up on a sleeve (52, 54) or a shaft, having a first and a second wall (28, 30) which are arranged at a distance parallel to each other, wherein each of the walls (28, 30) has a guide (40, 42) for receiving one end each of the shaft or of a shaft journal, which can be received in an opening in the sleeve, wherein the guide (40, 42) has a substantially vertically running supply portion (40*b*) for supplying a toilet-paper roll (12, 14), the supply portion merging into an unrolling portion (40*c*) running at an inclination with respect to the vertical in the direction of at least one first tear-off element (60, 62) or a stop (72).

16 Claims, 3 Drawing Sheets

(56) References Cited

Figure 1:
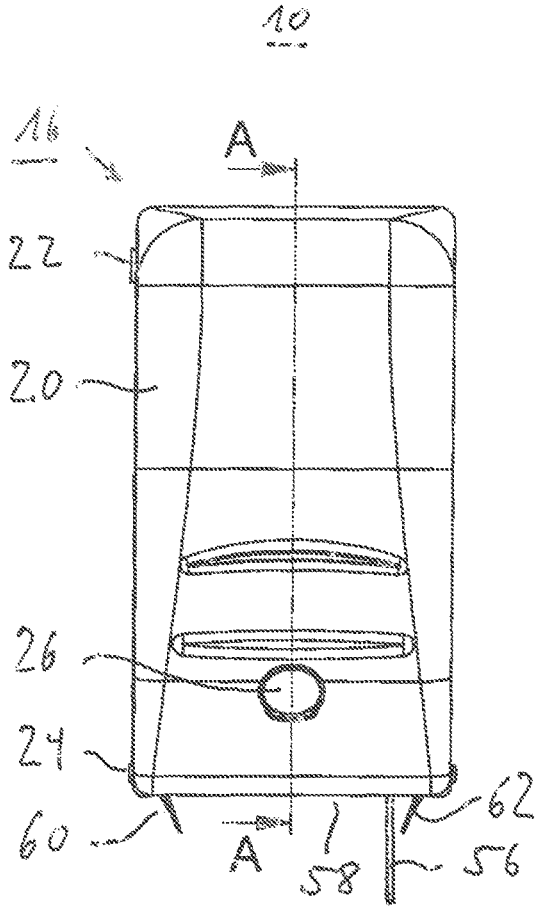

U.S. PATENT DOCUMENTS 3,058,682 A * 10/1962 Mott ..... A47K 10/3687 242/560.3
3,382,021 A * 5/1968 De Woskin ..... A47K 10/38 242/560.3
3,572,602 A * 3/1971 Mott, Sr. ..... A47K 10/38 242/560.3
3,770,222 A * 11/1973 Jespersen ..... B65H 19/1836 242/560.3
4,108,389 A * 8/1978 Womack ..... A47K 10/38 242/560.3
4,206,858 A * 6/1980 DeLuca ..... A47K 10/3687 225/106
4,340,195 A * 7/1982 DeLuca ..... A47K 10/3687 226/110
4,844,361 A * 7/1989 Granger ..... A47K 10/3687 225/93
4,944,466 A * 7/1990 Jespersen ..... A47K 10/3687 242/560.3
5,271,574 A * 12/1993 Formon ..... A47K 10/36 242/560.3
5,288,032 A * 2/1994 Boone ..... A47K 10/36 242/560.3
5,558,302 A * 9/1996 Jesperson ..... A47K 10/3687 242/560
6,082,664 A * 7/2000 Phelps ..... A47K 10/38 242/560
7,338,007 B2 * 3/2008 Valot ..... A47K 10/36 242/559
7,980,506 B2 * 7/2011 Kling ..... A47K 10/38 242/560
8,439,293 B2 * 5/2013 Hagleitner ..... A47K 10/3687 242/560.3
2008/0078855 A1 * 4/2008 Forman ..... A47K 10/3836 242/560
2009/0179104 A1 * 7/2009 Hagleitner ..... A47K 10/38 242/560
2009/0266928 A1 * 10/2009 Friesen ..... A47K 10/3687 242/559.4
2012/0256036 A1 * 10/2012 Osborne ..... A47K 10/38 242/560

FOREIGN PATENT DOCUMENTS

DE 10 2011 004 511 A1 8/2012
EP 1 618 820 A1 7/2005
WO 2008/004920 A1 1/2008
WO 2008/014528 A1 2/2008

OTHER PUBLICATIONS

Espacenet English abstract of CH 571994 A5.
Espacenet English abstract of DE 10 2011 004 511 A1.
Search Report issued by the Patent Office of Georgia, dated Jan. 24, 2019.

* cited by examiner

TOILET-PAPER-ROLL HOLDER

The invention relates to a holder for at least two toilet paper rolls, which are positioned one above the other, and which consist of a paper web wrapped around a tube or a shaft, comprising a first and a second wall arranged parallel to each other at some distance apart, whereby each of the walls has a guide for accepting a respective end of the shaft or a respective shaft journal that can be accommodated in an opening of the tube, whereby the guide comprises an substantially vertically extending feeding section, which is intended for feeding a toilet paper roll, and which transitions into an unrolling section, which extends obliquely relative to the vertical in the direction of at least one first tear-off element or limit stop, whereby the lower toilet paper roll situated in the unrolling section on account of its own weight bears with its circumferential surface against the limit stop, and whereby the paper web can be unrolled from the toilet paper roll through a dispensing opening and can be torn off at the at least one tear-off element.

A holder for toilet paper rolls of the above-mentioned type is described in CH 571 994 B. The holder comprises a first holding device, to maintain a first toilet paper roll in a dispensing position, in which a user can withdraw a section of the material web, and to move the pegs from a first position, in which the roll is full, to a second position, in which the roll is at least nearly empty. Further provided is a second holding device, to maintain at least a second roll releasably in a reserve position above the dispensing position, whereby the first and the second holding devices are linked to each other via at least one pivotable lever, which in the first holding device interacts with the pegs of the first tube in order to respond to the latter's position, in order to maintain the second roll in the reserve position as long as the pegs of the first roll move from the first into the second position, and in order to automatically release the second roll from the reserve position when the pegs have reached the second position, and finally by a guiding device to guide the second roll from the reserve position into the dispensing position when the lever releases the second roll. For the purpose of securing that the roll can only be employed in a specific location in the dispensing device, it is intended that the pegs have different diameters and the guide channels have different widths.

In this embodiment as well, a circumferential surface of the paper roll is in contact with the front wall that comprises a tear-off edge, so that unrolling can only take place in one direction.

DE 2 205 186 A discloses a further holder for toilet paper rolls. The holder consists of a base plate to which a domed cover is attached in a mountable and lockable manner. From the base plate originate two walls that are arranged at a distance from each other in parallel. Each of the walls has a guide to accept the respective end of a shaft carrying the paper rolls or a respective shaft journal that can be accepted in the opening of a tube.

The guide comprises an unrolling section, which extends obliquely into the direction of a pull-off device, whereby a toilet paper roll in use is in contact with its circumferential surface against belts of the pull off device. In this embodiment known in the art, the pull-off device is embodied as an automatic device for unrolling and dispensing the paper that is wound onto the rolls. The guide further comprises a feeding section, which extends substantially vertically, merges with the unrolling section, and is intended to accommodate a reserve toilet paper roll.

In the embodiment known in the art, the shaft is guided in slots of two laterally mounted vertical pieces of sheet metal that are attached to the base plate. The guides are open at their upper ends, so that the shafts with the toilet paper rolls can be inserted from above. A pendulum lever is used to control that toilet paper roll that is located in the upper area of the slots and serves as a reserve is then transferred into the oblique region of the guides, once the roll that had been present there previously has been used up completely and the empty tube has been ejected downward. The automatic device for unrolling and dispensing the paper that is wound onto the rolls is susceptible to faults. Furthermore, the toilet paper rolls must always be inserted in the same specified orientation in order to allow an automatic unrolling.

Described in DE 10 2011 004 511 A1 is a holder for toilet paper rolls that comprises two parallel lateral end plates, which are connected by a front wall. In this, the front wall forms a lower tear-off edge. Each of the end plates contains a guide for the support of the respective end of a shaft accommodating the toilet paper roll. The guides contain a main section, which extends in the direction toward the tear-off edge at the front wall and is embodied at least substantially rectilinear. For the purpose of ensuring that a correct tear-off edge is always available irrespective of the diameter of the toilet paper roll, the publication provides a force-applying device that shifts the toilet paper roll in the direction toward the tear-off edge. The force-applying device is embodied as an arm, which is pivotably mounted, and which as a result of spring-loading bears against the ends of the shaft that carries the toilet paper roll. This embodiment is of a structurally complicated design and consequently more susceptible to failure. The three-applying device pushes the toilet paper roll, in particular the latter's circumferential surface, against an interior surface of the front wall, so that unrolling can only take place in one direction.

On this basis, the objective of the present invention is to further develop a holder for toilet paper rolls of the above-mentioned type in such a way it has a structurally simple and low-maintenance design. Further, an unrolling of the toilet paper should be possible independently of the winding direction of the toilet paper roll.

This objective is met by the invention owing to, among other features, a first wall that forms a rear wall or is connected to a rear wall in such a way that the rotational axis of the toilet paper roll extends perpendicular to the rear wall, whereby irrespective of its unwinding direction, the toilet paper roll can be accepted and unrolled in the guides of the first and the second wall, a limit stop that, with reference to the circumferential surface of the toilet paper roll, has a convex surface, which facilitates an unrolling of the toilet paper roll in both directions, and a second tear-off element that is comprised in the holder and that substantially is arranged in parallel and on the opposite side of the dispensing opening relative to the first tear-off element, whereby the first and the second tear-off elements form lateral margins of the dispensing opening.

In comparison to the state of technology, the invention's holder is in particular characterized in that the toilet paper rolls can be inserted into the holder independently of their winding direction, which in particular facilitates simple and error-free servicing. Unwinding the toilet paper rolls independently of their winding direction is facilitated by a special surface configuration of the limit stop, with which an outer circumferential surface of the toilet paper roll is in contact during the unrolling. In accordance with the invention, it is intended that the surface is embodied convex, so that identical low forces are applied both during a left-hand rotation as well as a right-hand rotation of the toilet paper roll.

In a preferred embodiment, the surface may have a surface structure, such as ridges or nubs, to set a friction level suitable for a particular paper type.

In connection with the feature that the toilet paper rolls are supported in the holder in such a way that their rotational axes are oriented perpendicular to the rear wall, one can also realize a dispensing of the paper web on both sides from a bottom-sided dispensing opening, whereby the latter is laterally bordered by tear-off elements, which facilitate tearing off the paper web on the respective dispensing side.

The embodiment according to the invention facilitates a mode of use in which the toilet paper roll can be inserted into the holder in such a way that the paper web hangs from the dispensing opening on the holder's lateral surface that faces away from the user, so that after tearing off the paper web at the tear-off element that is nearer to the user, an end section of the paper web will be of such a length that the end of the paper web will fall out of the dispensing opening beyond the tear-off elements and consequently can easily be taken hold of.

An especially preferred embodiment is characterized in that the convex surface is formed by a section of a side wall, of a bolt, or of a shaft.

Particularly preferred convex surfaces have a radius R in the range of 2.5 mm≤R≤10 mm, preferably R=5 mm, to allow a two-sided unrolling with only minimal force application.

In order to ensure an ejection of the tube or shaft of a used toilet paper roll, it is intended that the obliquely extending unrolling section, together with the guide, transitions into a ejection section that extends substantially vertically from top to bottom, whereby the bolt is arranged at level height of a transition region between the unrolling section and the ejection section, and whereby the convex surface is situated at a distance from the guide in the transition region that corresponds substantially to one radius of the tube.

To be able to use toilet paper rolls with tubes of various diameters in the holder it is intended that the bolt can be fixed in positions of various distances relative from the guide.

In a particularly preferred embodiment, it is intended that the bolt or the shaft extends between the first and the second wall and is oriented in parallel to the rotational axis of the toilet paper roll.

The tear-off elements are preferably embodied as side-wall sections connecting the first and the second wall in the area of the dispensing opening, whereby the tear-off elements comprise a first section that forms the side wall section between the first and the second wall, and a second section, whose margin is embodied as a serrated edge.

The section of the tear-off element that comprises the serration preferably is angled in the direction of the dispensing opening, to facilitate an easy tearing off of the paper web.

It is further intended that the first and the second wall together with the side wall sections form a module, which preferably is fastened to the rear wall of the housing and can be covered with the hooded cover. This way different embodiments of holders, such as e.g. electrical or mechanical holders, may be realized and arranged in one housing.

An alternative embodiment relates to a bolder for at least two toilet paper rolls, which are positioned one above the other and consist of a paper web wound onto a tube or shaft, comprising a first and a second wall that are arranged at some distance from each other in parallel, whereby each of the walls contains a guide for accepting one respective end of the shaft or a respective shaft journal, which can be accommodated in a tube, whereby the lower toilet paper roll that is situated in the guide, on account of its own weight, along its circumferential surface bears on a limit stop, and whereby the paper web can be unrolled from the toilet paper roll through a dispensing opening and can be torn off using at least one tear-off element.

This embodiment is characterized in that the first wall forms a rear wall or is connected with such a rear wall in such a manner that the rotational axis of the toilet paper roll extends perpendicular to the rear wall, and that the limit stop has, relative to the circumferential surface of the toilet paper roll, a convex surface.

A preferred embodiment is characterized in that that the holder comprises a first and a second tear-off element, whereby the first tear-off element and the second tear-off element are arranged on opposing sides of the dispensing opening.

In order to avoid that the toilet paper roll in the operational position is pushed back into the feeder section it is intended that arranged in the guide is a locking element, which prevents the toilet paper roll in the operational position from being pushed back.

The locking element is embodied as a slider, which is displaceably mounted transversely to the guide in the second guide element, more specifically in the unrolling section that extends inclined to the vertical.

Preferably the slider bears with one end against the inner surface of the first guide element, either due to gravity or to spring-loading.

The end of the slider that protrudes into the guide is embodied as a wedge shape on the feed side and has an oblique surface, so that when the toilet paper roll passes by, the end of the shaft or the shaft journal can move the slider into an open position, and after the passing of the end of the shaft or the shaft journal, the slider falls into a closed position, either due to gravity spring-loading.

Further details, advantages, and features of the invention are not only found in the claims, the characteristic features specified therein, individually and/or in combination, but also in the following description of a preferred embodiment example that is shown in the figures.

Figure 2:
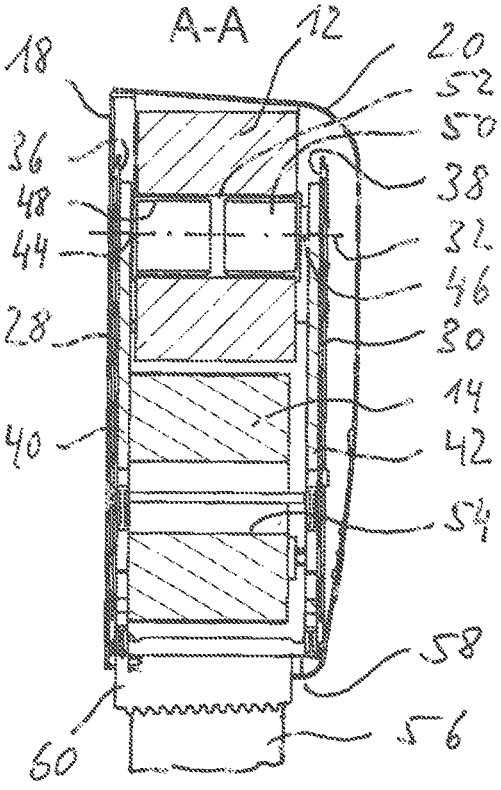
Figure 3:
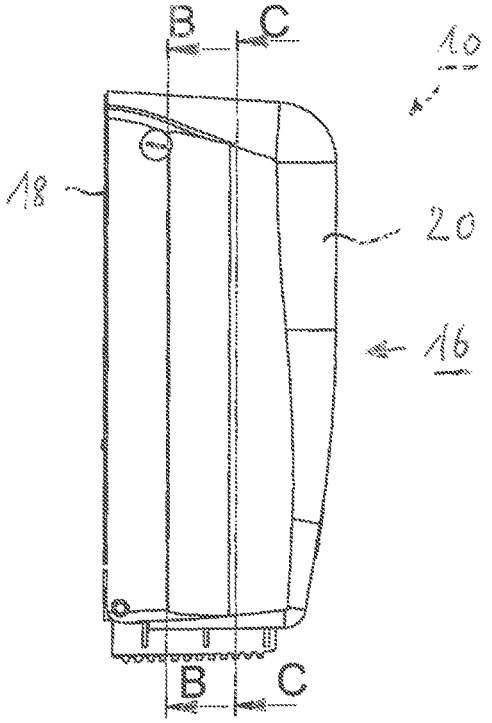
Figure 6:
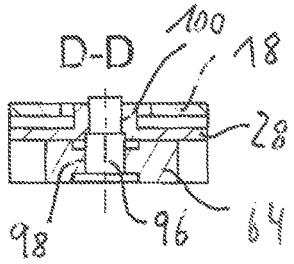
Figure 5:
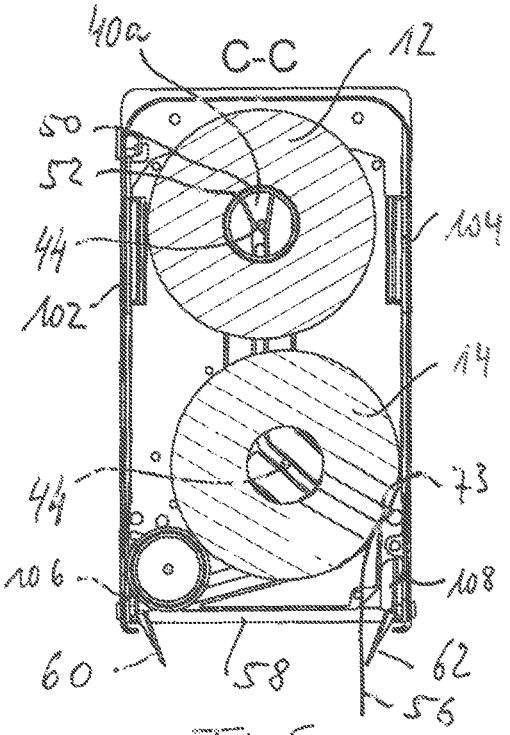
Figure 4:
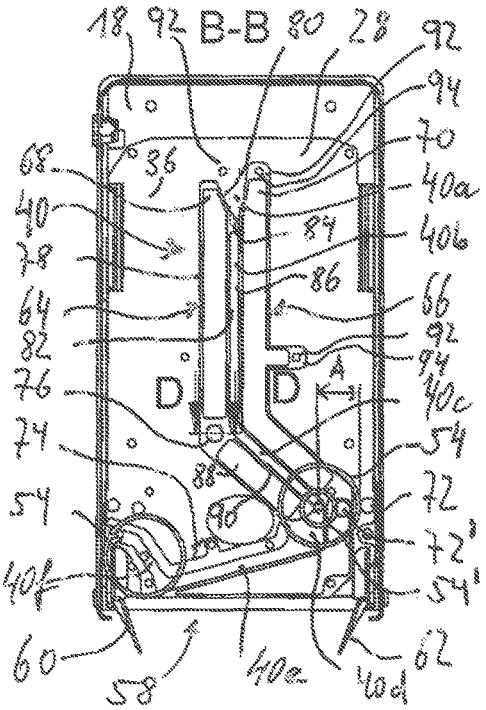
Figure 7:
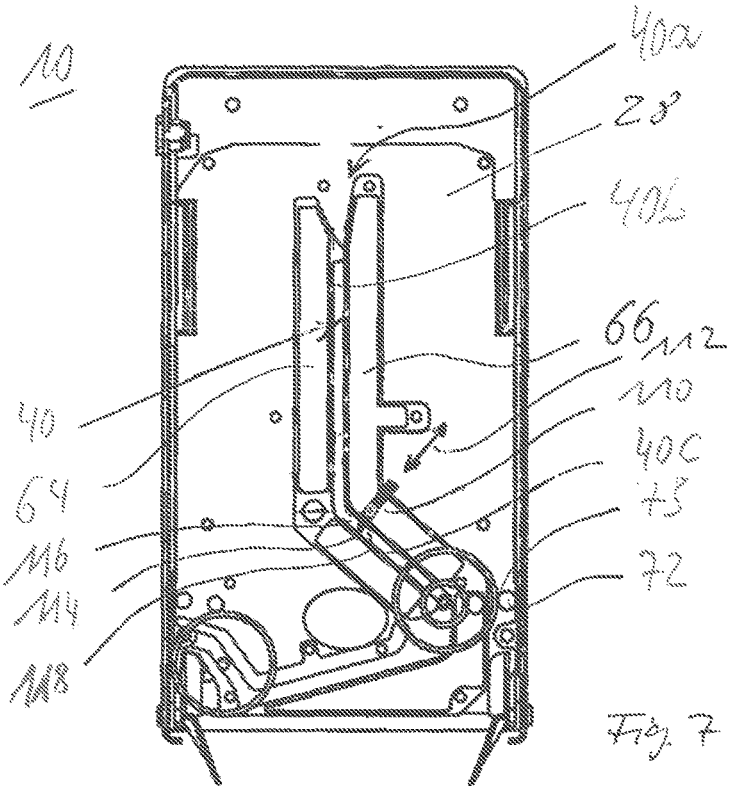
Figure 8:
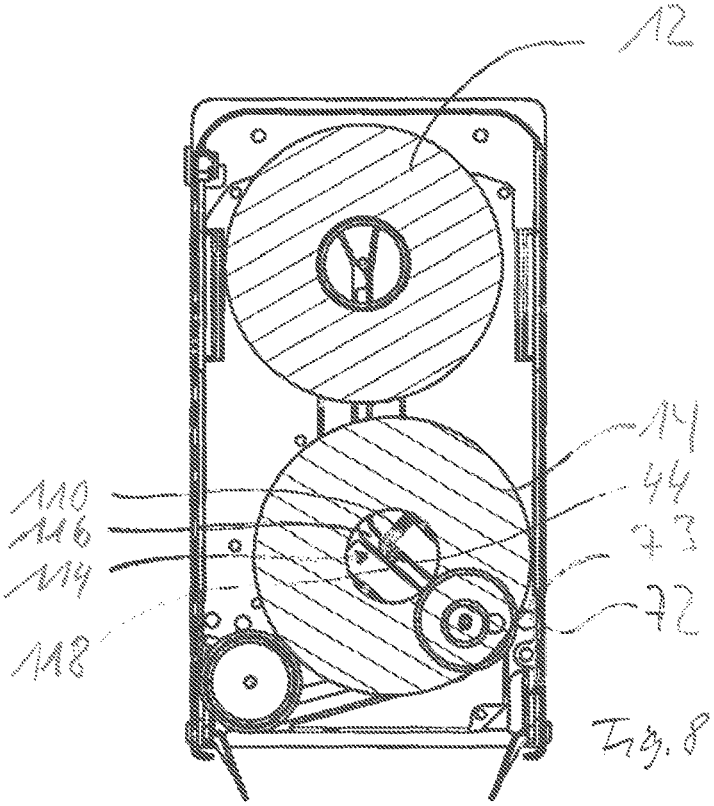

The figures show:

FIG. 1 shows a front view of a holder for toilet paper rolls,

FIG. 2 shows a side view of the holder in a sectional view along the section line A-A of FIG. 1, FIG. 3 shows a side view of the holder of FIG. 1, FIG. 4 shows a front view of the holder in a sectional view along the section line B-B of FIG. 3, FIG. 5 shows a front view of the holder in a sectional view along the section line C-C of FIG. 3, FIG. 6 shows a sectional view along a section line D-D of FIG. 5, of a mounting for a pendulum lever, FIG. 7 shows a front view of the wall with the guide for accepting the end of shaft or a shaft journal, and FIG. 8 shows a front view of the opened toilet paper roll holder with two toilet paper rolls arranged on top of each other.

FIG. 1 shows a front view of a holder 10 for at least two toilet paper rolls 12, 14. The holder 10 comprises a housing 16 with a rear wall 18 that serves to mount the holder 10 to a wall. On the rear wall 18, a hooded cover 20 is arranged pivotably by means of an hinge 22 and is lockable by means of a lock 24. Provided in a front side of the hooded cover 20 is an inspection window 26, through which the depletion of toilet paper of a toilet paper roll 14 in use can be monitored.

The holder 10 comprises a first, rear wall 28, which extends in parallel to the rear wall 18 and is connected to the latter. In parallel and at some distance to this first, rear wall 28 is arranged a second, front wall 30, whereby the toilet paper rolls 12, 14 are arranged between the walls 28, 30 in such a manner that a rotational axis 32, 34 extends perpendicular to the rear wall 18. As a result, the toilet paper rolls rotate in a plane that is parallel to the rear wall 18, so that the holder 10 can be embodied with a small depth even when toilet paper rolls with large diameters are used.

On each of the respective interior sides 36, 38 of the walls 28, 30 that face the toilet paper rolls 12, 14, is provided a guide 40, 42, which have an ovoid cross section, in which are accommodated and guided shaft journals 44, 46 that protrude beyond the ends of the toilet paper rolls 12, 14 along the axial direction. The shall journals 44, 46 are end sections of caps 48, 50, which are inserted into the respective openings in the end-faces of a tube 52, 54 of the toilet paper roll 12, 14. The shall journals may also be the end sections of a shall passing through the toilet paper roll 12, 14.

A paper web 56, which in general is not perforated, of the toilet paper roll 14 in use is withdrawn from a bottom-sided dispensing opening 58 and may be torn off at the desired length using a first and a second tear-off element 60, 62, which border the dispensing opening on its sides. The tear-off elements 60, 62 form lateral connecting elements between the first wall 28 and the second wall 30 and extend perpendicular to the rear wall 18.

FIG. 3 shows a side view of the holder 10 with the housing 16 in the closed state.

FIG. 4 shows in a sectional view along the section line 13-B of FIG. 3 a front view of the first, rear wall 28 with the guide 40. The second, rear wall 30 with the guide 42 is embodied correspondingly mirror symmetrically and consequently is not explained in more detail.

The guide 40 is embodied on a surface of the interior side 36 of the wall 28 and laterally is limited by a first guide element 64 as well as a second guide element 66. The guide 40 comprises several sections. Originating from an upper end 68, 70 of the respective first and second guide elements 64, 66 extends a V-shaped first section 40*a* as a reserve section for accommodating a spare toilet paper roll 12. The first section 40*a* merges into a second section 40*b*, which extends vertically top-to-bottom and which forms a feeding section that serves to guide the toilet paper roll 12 into a position where it becomes available to the user.

The second section 40*b* merges into a third section 40*c*, which extends obliquely in a straight line in the direction towards the second tear-off edge 62. Consequently, the third section 40*c* forms an unrolling section that serves to use the weight of the toilet paper roll 14 to move it in the direction towards a lateral limit stop 72, whereby a circumferential surface of the toilet paper roll 14 in use is in contact with a surface 73 of the limit stop 72.

The third section 40*c* transitions to a fourth section 40*d*, which forms an ejection section that extends vertically from top to bottom and serves to eject the empty tube 54 when the toilet paper roll 14 in use has been exhausted.

The ejection section is followed by a fifth section 40*e*, which extends obliquely in the direction towards the first tear-off edge 60 and forms a discharge section that is embodied to discharge the empty tube 54.

The guide 40 finally comprises a sixth section 40*f*, which extends obliquely upward and forms a extracting section that serves to allow the empty sleeve 54 to be laterally removed from the guide 40.

When an empty tube is situated at the lowest point of the discharge section 40*e*, the preferably colour-marked nubs 48, 50 are visible from the outside, so that the service personnel receives an optical indication to exchange the empty tube.

In the direction towards the dispensing opening 58, the discharge section 40*e* is bordered by the second guide element 66. To act as an upper limit, a third guide element 74 is provided, which is arranged on the surface 32 of the wall 28, at a distance above the second guide element 58.

The first guide element 64 is embodied as a pendulum lever, which is pivotably mounted on a hinge 76 that is arranged in the transition area between the feeding section 40*b* and the unrolling section 40*c*. The pendulum lever 64 comprises a first arm 78, which together with an obliquely extending lateral surface 80 forms a margin for the reserve section 40*a*, and together with a lateral surface 82 extending straight forms a lateral limit for the feeding section 40*b*.

In a transition region between the oblique lateral surface 80 and the straight lateral surface 82 is provided a projection 84 that can be brought into contact against a lateral surface 86 of the second guide element 66 in order to block the feeding section 40*b*.

Furthermore, the pendulum lever 64 has a second arm 88 that extends from the hinge 78 in the direction of the vertically extending ejection section 40*d* and ends at the level of the limit stop 72. A lateral surface 40 of the second arm 88 forms a lateral lower limit of the unrolling section 40*c*, on which bears the peg 44 of the toilet paper roll 14 in use, so that the projection 84 of the first arm 78 of the pendulum lever 64 is pressed against the lateral surface 86 of the second guide element 66, to prevent the toilet paper roll 12 that is blocked in the reserve section 40*a* from advancing into the feeding section 40*b*, and consequently into the unrolling section 40*c*.

FIG. 5 shows in a front view a sectional view of the holder along the section line C-C of FIG. 3, whereby the toilet paper roll 11 serving as reserve in the reserve section 40*a* is blocked by the projection 84 of the first arm 78, and whereby the toilet paper roll 11 in use, together with its peg 44, is located in the unrolling section 40*c*, while the toilet paper 14 with its circumferential surface is in contact with the limit stop 72, and the paper web 56 emerges from the lower dispensing opening 58.

Due to the weight of the toilet paper roll, a force is applied to the second arm 88 of the pendulum lever 64 in such a way that that the first arm 78 with the projection 84 is pushed against the inner surface 88 of the second guide element 66, so that the toilet paper roll 12 intended as the reserve is locked in the reserve area 40*a*.

Continued use of the toilet paper web 56 reduces the diameter of the toilet paper roll 14 in use, so that in the course of increasing consumption the toilet paper roll 14 is moved into the direction of the ejection section 40*d*.

As soon as the toilet paper roll 14 in use has reached a diameter that substantially corresponds to a distance A between the end of the second arm 88 or the end of the unrolling section 40*c* and a surface of the limit stop 72, the tube 54 falls into the vertically extending ejection section 40*d* and is guided through the discharge section 40*e* into the removal section 36*f*.

In accordance with the invention, the limit stop 72 has a convex surface 73 and is embodied as a bolt that extends between the first wall 28 and the second wall 30, whereby a distance between the end of the second arm 28 or the end of the unrolling section 40*c* and the surface 73 or the bolt 72 substantially corresponds to the radius of the tube 54 accommodating the toilet paper roll, so that when the toilet paper web 56 has been consumed, gravity causes the tube 54 to fall into the ejection section 40*d*.

The invention's feature of a limit stop 72 with a convex surface ensures that the toilet paper roll 14 in use can be unrolled in both directions. Since the toilet paper roll 14 can be unrolled in a plane that extends in parallel to the rear wall, one achieves the additional advantage that the paper web 56 can be torn off at the tear-off element 62 given a right-direction-unrolling toilet paper roll and can be torn off at the tear-off element 60 given a left-direction-unwinding toilet paper roll. The surface may have a surface structure in the form of a corrugation along the transverse or longitudinal direction.

In comparison to the state of technology, one achieves the advantage of being able to realize a holder 10 of low depth irrespective of the diameter of the toilet paper rolls 12, 14, whereby the toilet paper rolls 12, 14 can be inserted independently of their winding direction, which allows particularly simple and error-free servicing, since the service personnel does not have to worry about the winding direction when inserting the toilet paper rolls.

The holder 10 is further characterized in that the limit stop in form of the bolt 72 can be arranged in various positions. FIG. 4 shows a bolt 72' in a position, whereby a distance between the bolt 72' and the end of the second arm 88 is reduced. This creates the option of employing paper rolls with tubes 54' of a lesser diameter. Embodied in the walls 28, 30 are corresponding receptacles, so that depending on the intended use the holder may hold either bolts 72 for tubes 54 of larger diameter or bolts 72' for tubes 54' of lesser diameter.

In addition to the invention's embodiment of the limit stop 72 with a convex surface, the embodiment of the holder 12 is characterized by a particularly uncomplicated mechanical structure. For example, the walls 28, 30 as well as the first, second, and third guide elements respectively are embodied as identical components that can be used on either side. For the purpose of fastening the first, the second, and the third guide elements, the walls 28, 30 are provided with respective pins or nubs 92 in mirror-image positions for securing in position the guide elements 64, 66, 74. In this, the guide elements contain openings 94, which are fitted onto the pins or nubs 92 and subsequently are welded in place, for example by a heat-applying process.

FIG. 6 shows a sectional view of the hinge 76 for the rotatably articulated mounting of the pendulum lever 64. The hinge 76 comprises a shaft 96, which extends through the opening 98 of a pendulum lever 64 and is secured in a mounting 100 of the wall 28.

For the purpose of maintaining a distance between the rear wall 28 and the front wall 30 are provided spacer elements 102, 104 as well as sections 106, 108 of the tear-off elements 60, 62, which substantially extend vertically from a marginal section of the rear wall 28 and can be connected, such as welded, to a marginal section of the front wall 30.

FIG. 7 shows a front view of a holder 10 in the opened state without toilet paper rolls 12, 14. The guide 40 is mounted to the wall 28. As already explained with respect to FIG. 4, the guide 40 comprises several sections, specifically a first section 40 as a reserve section for accommodating the spare toilet paper roll 12, a second, vertically extending section 40 *b*, which forms a feeding section to guide the toilet paper roll into a position where it is available to the user, as well as a third section 40 *c*, which extends obliquely relative to the vertical and forms an unrolling section, which serves to guide the toilet paper roll 14 in use towards the lateral limit stop 72 using the former's own weight, whereby the circumferential surface of the toilet paper roll 14 in use is in contact with the surface 73 of the limit stop 72.

The guide 40 is bordered by the first guide element 64 as well as the second guide element 66. The guide elements 64, 66 are mourned on the wall 28 and form the substantially U-shaped guide 40.

In an embodiment with its own inventive merit, a locking element 110 is arranged along the body of the guide 40 that prevents careless handling by a user from inadvertently pushing the lower in-use toilet paper roll 14 upward, i.e. in the direction of the vertical feeding section 40 *c*. The locking element 110 is arranged in the unrolling section 40 *c* that extends obliquely relative to the vertical. In this, the locking element 110 is embodied as a slider, which is arranged in a section of the second guide element 66 that extends obliquely relative to the vertical. The slider 110 is displaceably mounted, transversely relative to the guide and along the direction of the arrow 112, in the second guide element, whereby in the closed position an end 114 of the slider 110 rests against the first guide element 64.

The end 114 of the slider that protrudes into the guide 40 is embodied with a wedge shape on the feed side and has an oblique surface 114, so that the end 40 of the shaft or the shaft journal of a toilet paper roll guided from the feeding section into the unrolling section causes the slider 110 to open.

In this, it is ensured that the slider is lifted when passing the end of the shaft or the shaft journal, and that after passing the end or the shaft journal it automatically falls back into its original position, either due to gravity or spring loading, which prevents the toilet paper roll from being pushed back.

In the event of a movement in the opposite direction, the end of the shaft or the shaft journal is pushed against an even surface 188 of the slider 110, so that the latter remains in the closed position, as is shown in FIG. 8. This prevents that pushing back the lower toilet paper roll 14 causes the the reserve toilet paper 12 to be inadvertently released from its position in the reserve section 40*a*. The slider 110 preferably is mounted inclined relative to the vertical, so that gravity can cause it to fall from its opened position into the closed position. Another option is that the slider 110 is displaceably mounted in the second guide element 66 under spring load.

The invention claimed is:

1. A holder for at least two toilet paper rolls, which are positioned one above the other, and which consist of a paper web wound around a tube or a shaft, the holder comprising:

a first wall and a second wall arranged at a distance from each other in parallel, wherein the first wall forms a rear wall, or is connected to such a rear wall in such a way that a rotational axis of the toilet paper roll extends perpendicularly to the rear wall, wherein each of the walls contains a guide for accepting the respective end of a shaft, or a respective shaft journal that can be accommodated in the opening of the tube, wherein the guide has a substantially vertically extending feeding section, for feeding a toilet paper roll, that transitions into an unwinding section, which extends at an angle to the vertical in the direction of at least one tear-off element, wherein the lower toilet paper roll that is situated in the unrolling section on account of its own weight bears against a limit stop, and wherein the paper web can be unwound from the toilet paper roll through a dispensing opening, and can be torn off at the at least one tear-off element, wherein the toilet paper roll, independently of its unrolling direction, can be accepted and unwound in the guides of the first and the second wall, wherein the limit stop is formed by a section of a side wall, or a bolt, and extends between the first and the second wall, and extends in parallel to the rotational axis of the toilet paper roll, and has, relative to the circumferential surface of the toilet paper roll which bears against the limit stop, a convex surface, which facilitates unwinding the toilet paper roll in both directions, wherein the holder comprises a second tear-off element, which substantially is arranged in parallel to the first tear-off element on the opposite side of the dispensing opening, and wherein the first and the second tear-off elements form lateral limits of the dispensing opening (58).

2. The holder according to claim 1, wherein the convex surface has a radius R in the range of 2.5 mm≤R≤10 mm.

3. The holder according to claim 1, wherein the surface is embodied with a surface structure, such as ridges or nubs.

4. The holder according to claim 1, wherein the unrolling section of the guide that extends at an angle to the vertical transitions into a substantially vertically extending ejecting section wherein the bolt is arranged at level height of a transition area between the unwinding section and the ejecting section, and wherein the convex surface is separated from the guide in the transition region by a distance that substantially corresponds to one radius of the tube.

5. The holder according to claim 1, wherein the bolt is able to be fixed at different separation distances from the guide in dependence on the radius of the employed tube.

6. The holder according to claim 1, wherein the tear-off elements are embodied as side-wall sections to connect the first and the second wall in the area of the dispensing opening.

7. The holder according to claim 1, wherein the tear-off elements comprise a first section that forms the side-wall section between the first and the second wall, as well as a second section with a margin that is embodied as a tear-off serration.

8. The holder according to claim 7, wherein the section of the tear-off element that is equipped with the tear-off serration is angled towards the direction of the dispensing opening.

9. The holder according to claim 1, wherein the first and the second walls, together with the side wall sections, form a module, which is attached at the rear wall of the housing and can be covered by the covering.

10. A holder for at least two toilet paper rolls, which are positioned one above the other, and consist of a paper web wound onto a tube, or shaft, the holder comprising:

a first wall and a second wall arranged at a distance parallel to each other, wherein the first wall forms a rear wall, or is connected to such a rear wall in such a way that a rotational axis of the toilet paper roll extends perpendicular relative to the rear wall, wherein the first wall and the second wall have a guide for accepting the respective end of the shaft, or a shaft journal that can be accommodated in the tube, wherein the toilet paper roll that is situated lower in the guide due to its own weight with its circumference bears against a limit stop, and wherein the paper web can be unwound from the toilet paper roll through a dispensing opening and can be torn off using at least one tear-off element, wherein the limit stop is formed by a section of a side wall, or a bolt, and extends between the first and the second wall and extends in parallel to the rotational axis of the toilet paper roll, and has a convex surface, relative to a circumferential surface of the toilet paper roll, and wherein the holder comprises a first and a second tear-off element arranged on opposite sides of the dispensing opening.

11. The holder according to claim 1, wherein, arranged in the guide, is a locking element, which prevents the toilet paper roll in use from being pushed back into the feeding section of the guide.

12. The holder according to claim 11, wherein the locking element is embodied as a slider, which, in the second guide element, is displaceably mounted transversely to the guide in the unrolling section that extends inclined relative to the vertical.

13. The holder according to claim 12, wherein the locking element with its end bears against an inner surface of the first guide element, either due to gravity, or spring loading.

14. The holder according to claim 13, wherein the end of the locking element that protrudes into the guide is embodied wedge-shaped on the feed side, and has an oblique surface, so that when the paper roll passes by, the locking element can be displaced by the ends of the shaft, or the shaft journals, into an open position, and after the ends of the shaft, or the shaft journals, have passed, it falls into a closed position, either due to gravity, or to spring-loading.

15. The holder according to claim 10, wherein the locking element is arranged with respect to the limit stop at a distance that substantially corresponds to one radius of the toilet paper roll.

16. The holder according to claim 2, wherein the radius R is 5 mm.

* * * * *